US005248986A

United States Patent [19]

Marshall

[11] Patent Number: 5,248,986

[45] Date of Patent: Sep. 28, 1993

[54] UNIVERSAL SWIVEL DEVICE FOR AN ADJUSTABLE ANGLE VEHICULAR ANTENNA

[76] Inventor: Greg Marshall, 5779 Haleola St., Honolulu, Hi. 96821

[21] Appl. No.: 788,860

[22] Filed: Nov. 7, 1991

[51] Int. Cl.[5] ..... H01Q 1/32

[52] U.S. Cl. ..... 343/715; 343/882

[58] Field of Search ..... 343/715, 878, 880, 882, 343/888, 900; 174/138 A, 152 A, 153 A; 439/916

[56] References Cited

U.S. PATENT DOCUMENTS

| | | | |
|---|---|---|---|
| 4,190,839 | 2/1980 | Liautaud | 343/715 |
| 4,243,989 | 1/1981 | Piper | 343/715 |
| 4,431,332 | 2/1984 | Dieges | 343/715 |

FOREIGN PATENT DOCUMENTS

| | | | |
|---|---|---|---|
| 2064878 | 6/1981 | United Kingdom | 343/715 |

*Primary Examiner*—Michael C. Wimer

*Attorney, Agent, or Firm*—Michael I. Kroll

[57] ABSTRACT

A universal swivel device is mounted between a vehicular mount assembly and an elevated feed assembly of an adjustable angle vehicular antenna in which the vehicular mount assembly is of the type having a housing, a threaded collar, a contact button, an insulator, a bracket with mounting screws to engage a vehicular structure of a motor vehicle, a grommet and a gasket, while the elevated feed assembly is of the type having an antenna extension and a mounting base with internal threads. The universal swivel device consists of a base assembly connectable onto the threaded collar of the vehicular mount assembly. A swivel assembly is carried within an upper portion of the base assembly and is connectable into the internal threads of the mounting base of the elevated feed assembly. A double acting contactor assembly is carried within a lower portion of the base assembly to always maintain a constant contact between the swivel assembly and the contact button in the vehicular mount assembly.

6 Claims, 1 Drawing Sheet

"SURFACE A"
"SURFACE B"
"SURFACE C"
"SURFACE D"
1A

UNIVERSAL SWIVEL DEVICE FOR AN ADJUSTABLE ANGLE VEHICULAR ANTENNA

BACKGROUND OF THE INVENTION

1. Field of the Invention

The instant invention relates generally to antennas for motor vehicles and more specifically it relates to a universal swivel device for an adjustable angle vehicular antenna.

2. Description of the Prior Art

Numerous antennas for motor vehicles have been provided in the prior art that are adapted to be mounted to various locations on the motor vehicles. While these units may be suitable for the particular purpose to which they address, they would not be as suitable for the purposes of the present invention as heretofore described.

SUMMARY OF THE INVENTION

A primary object of the present invention is to provide a universal swivel device for an adjustable angle vehicular antenna that will overcome the shortcomings of the prior art devices.

Another object is to provide a universal swivel device for an adjustable angle vehicular antenna in which the adjustable angle permits the radiating portion of the antenna to be positioned at or near vertical thereby reducing or eliminating transmission path losses due to cross-polarization and phasing effects.

An additional object is to provide a universal swivel device for an adjustable angle vehicular antenna in which the design of the universal swivel assembly permits consistent capacitive coupling of the ground portion of the antenna throughout the swivel's angular movement range permitting a constant impedance characteristic for improved antenna to feed line impedance matching.

A further object is to provide a universal swivel device for an adjustable angle, vehicular antenna in which the universal swivel base contact assembly employs a unique double acting contactor which provides a consistent contact pressure to be exerted on both the universal swivel moving contact and the contact button.

A still further object is to provide a universal swivel device for an adjustable angle vehicular antenna in which the design of the base interface adaptor provides automatic loading of the double acting contactor spring and proper pressure seating of both upper and lower gaskets for weatherproofing the movable contact portion of the antenna.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 1A:
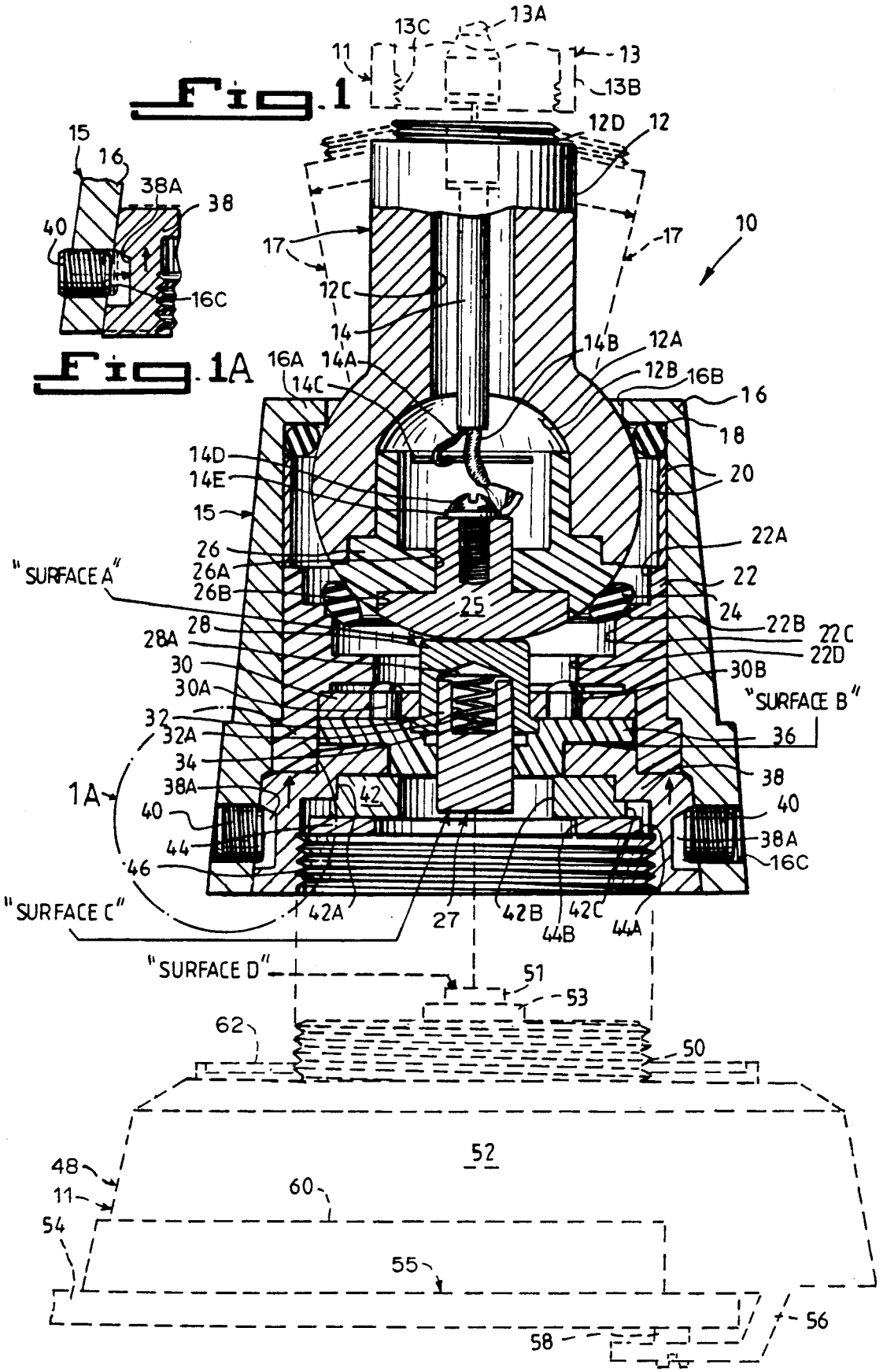
FIG. 1 is a cross sectional view of the instant invention with the vehicular mount assembly and the elevated feed assembly shown in dotted lines and exploded therefrom.
FIG. 1A is a portion of the cross sectional view of FIG. 1 showing the engagement operation of the socket head retaining screw with the side alignment groove in the interface adaptor.

Turning now descriptively to the drawings, in which similar reference characters denote similar elements throughout the several views, the Figures illustrate a universal swivel device 10 mounted between a vehicular mount assembly 48 and an elevated feed assembly 13 of an adjustable angle vehicular antenna 11 in which the vehicular mount assembly 48 is of the type having a housing 52, a threaded collar 50, a contact button 51, an insulator 53, a bracket 56 with mounting screws 58, a grommet 60 and a gasket 62, so that it can be mounted to a vehicular structure 54 on a motor vehicle 55. The elevated feed assembly 13 is of the type having an antenna extension 13A and a mounting base 13B with internal threads 13C. The universal swivel device 10 consists of a base member 15 connectable onto the threaded collar 50 of the vehicular mount assembly 48. A swivel assembly 17 is carried within an upper portion of the base assembly 15 and is connectable into the internal threads 13C of the mounting base 13B of the elevated feed assembly 13. A double acting contactor assembly 27 is carried within a lower portion of the base assembly 15 to always maintain a constant contact between the swivel assembly 17 and the contact button 51 in the vehicular mount assembly 48.

The swivel assembly 17 includes an upper housing 12, terminating into a bottom curved segment 12A having an interface 12B therein with a bore 12C extending upwardly from the interface 12B and a threaded collar 12D on top to engage with the internal threads 13C in the mounting base 13B of the elevated feed assembly 13. A lower housing 26 has a guide hole 26A and a mounting recess 26B. The lower housing 26 fits within the interface 12B of the bottom curved segment 12A of the upper housing 12. A movable contact 25 fits into the guide hole 26A and mounting recess 26B of the lower housing 26. A coaxial cable 14 extends through the bore **12*c* of the upper housing 12. The cable 14 has a shield 14A and a center conductor 14B. A ground member 14C is carried in the lower housing 26 and connected to the shield 14A of the cable 14. A lug 14E connected to the center conductor 14B of the cable 14. A screw 14D is engagable with the lug 14E and is threaded into the top of the movable contact 25 thereby connecting the antenna extension 13A of the elevated feed assembly 13 with the movable contact 25**.

The base assembly 15 includes an outer housing 16 having a top wall 16A with an aperture 16B therein to retain the bottom curved segment 12A of the upper housing 12 of the swivel assembly 17. A first gasket 18 is placed within the outer housing 16 between the top wall 16A and the bottom curved segment 12A of the upper housing 12 of the swivel assembly 17. A retainer member and swivel tension spring 20 is placed within the outer housing 16 to bear against the first gasket 18 and the bottom curved segment 12A of the upper housing 12 of the swivel assembly 17. A second gasket 24 is placed within the outer housing 16 against the lower housing 26. An inner housing 22 is provided and has an upper recess 22A and a lower recess 22D. The inner housing 22 is placed within the outer housing 16 to bear against the retainer member and swivel tension spring 20.

The double acting contactor assembly 27 includes a stationary contact member 28 having a seat 28A therein. A first guide member 30 fits over the stationary contact member 28 which fits into the inner housing 22 so that the stationary contact member 28 can engage with the moveable contact 25 of the swivel assembly 17 at surface "A". A contact spring 34 fits against the seat 28A of the stationary contact member 28. A contact button member 32 has a well 32A therein for holding the contact spring 34. A second guide member 36 fits over the contact button member 32. A pair of retainers 30A and 30B are for holding the first guide member 30 to the second guide member 36.

The base assembly 15 further includes the outer housing 16 having a pair of oppositely positioned side threaded apertures 16C therein. An interface adaptor 38 has a pair of oppositely positioned side alignment grooves 38A and a bottom internally threaded aperture 46, whereby the interface adaptor 38 fits against the housing 22 within the outer housing 16. The internally threaded aperture 46 can engage with the threaded collar 50 on the vehicular mount assembly 48. A pair of socket head retaining screws 40 are provided. Each screw 40 is threadable into one of the side threaded apertures 16C in the outer housing 16 to bear against one of the side alignment groove 38A in the interface adaptor 38 thereby tightening the contact between the movable contact 25 in the swivel assembly 17 and the stationary contact member 28 in the double acting contactor assembly 27 at surface "A" and of surface "B" between the interface adaptor 38 and second guide member 36. A first spacer member 42 has a first annular outer surface 42A, a second wider annular outer surface 42C and a clearance hole 42B.

Tightening of the socket head retaining screws 40 also forces the interface adaptor 38 upward compressing the second gasket 24 which tightens the rotation movement of the swivel assembly 17 and further forcing it against the first gasket 18, completing the tightening procedure.

The first spacer member 42 is placed against the second guide member 36. A second spacer member 44 has an annular outer surface 44A and an inner aperture 44B. The second spacer member 44 is placed against the first spacer member 42, so that the bottom internally threaded aperture 46 in the interface adaptor 38 can engage with the threaded collar 50 on the vehicular mount assembly 48.

The lower housing 26 in the swivel assembly 17, the inner housing 22 in the base assembly 15 and the second guide member 36 in the double acting contactor assembly 27 are all fabricated out of a non-conductive plastic material.

The first gasket 18 and the second gasket 24 are fabricated out of a rubber material whereby when the first gasket 18 and the second gasket 24 are properly pressure seated the movable contact 25 of the swivel assembly 17 will be weatherproofed and appropriate tension will be applied to the swivel assembly 17 to hold it in place.

LIST OF REFERENCE NUMBERS

10 universal swivel device
11 adjustable angle vehicular antenna
12 upper housing
12A bottom curved segment of 12
12B interface in 12A
12C C bore in 12
12D threaded collar on 12
13 elevated feed assembly
13A antenna extension
13B mounting base
13C internal threads in 13B
14 coaxial cable
14A shield of 14
14B center conductor of 14
14C ground member
14D screw
14E lug
15 base assembly
16 outer housing
16A top wall
16B aperture in 16A
16C side threaded aperture in 16
17 swivel assembly
18 first gasket
20 retainer member and swivel tension spring
22 inner housing
22A upper recess in 22
22B seat in 22
22C middle recess in 22
22D lower recess in 22
24 second gasket
25 movable contact
26 lower housing
26A guide hole in 26
26B mounting recess in 26
27 double acting contactor assembly
28 stationary contact member
28A seat in 28
30 first guide member
30A retainer for 30 and 36
30B retainer for 30 and 36
32 contact button member
32A well in 32
34 contact spring
36 second guide member
38 interface adaptor
38A side alignment groove in 38
40 socket head retaining screw
42 first spacer member
42A first annular outer surface on 42
42B clearance hole in 42
42C second annular outer surface on 42
44 second spacer member
44A annular outer surface on 44
44B inner aperture in 44
46 bottom internally threaded aperture in 38
48 vehicular mount assembly
50 threaded collar
51 contact button
52 housing
53 insulator
54 vehicular structure
55 motor vehicle
56 bracket
58 mounting screw
60 grommet
62 gasket It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A universal swivel device mounted between a vehicular mount assembly and an elevated feed assembly of an adjustable angle vehicular antenna in which the vehicular mount assembly is of the type having a housing, a threaded collar, a contact button, an insulator, a bracket with a mounting screw to engage a vehicular structure of a motor vehicle, a grommet and a gasket, while the elevated feed assembly is of the type having an antenna extension and a mounting base with internal threads, said universal swivel device comprising:

a) a base assembly is connected onto the threaded collar of the vehicular mount assembly;

b) a swivel assembly carried within an upper portion of said base assembly and is connected into the internal threads of the mounting base of the elevated feed assembly, said swivel assembly includes an upper housing terminating into a bottom curved segment having an interface therein with a bore extending upwardly from the interface and a threaded collar on top to engage with the internal threads in the mounting base of the elevated feed assembly, a lower housing having a guide hole and a mounting recess, said lower housing fits within the interface of the bottom curved segment of said upper housing, a movable contact which fits into the guide hole and mounting recess of said lower housing, a coaxial cable extending through the bore of said upper housing, said cable having a shield and a center conductor, a ground member carried in said lower housing and connected to the shield of said cable, a lug connected to the center conductor of said cable, a screw engageable with said lug and threaded into the top of said movable contact thereby connecting the antenna extension of the elevated feed assembly with said movable contact; and c) a double acting contactor assembly carried within a lower portion of said base assembly to always maintain a constant contact between said swivel assembly and the contact button in the vehicular mount assembly.

2. A universal swivel device as recited in claim 1, wherein said base assembly includes:

a) an outer housing having a top wall with an aperture therein to retain the bottom curved segment of said upper housing of said swivel assembly;

b) a first gasket placed within said outer housing between the top wall and the bottom curved segment of said upper housing of said swivel assembly;

c) a retainer member and swivel tension spring placed within said outer housing to bear against said first gasket and the bottom curved segment of said upper housing of said swivel assembly;

d) a second gasket placed within said outer housing against said lower housing; and e) an inner housing having an upper recess, a seat for said second gasket and a middle recess and a lower recess, said inner housing placed within said outer housing to bear against said retainer member and swivel tension spring.

3. A universal swivel device as recited in claim 2, wherein said double acting contactor assembly includes:

a) a stationary contact member having a seat therein;

b) a first guide member to fit over said stationary contact member which fits into said inner housing so that said stationary contact member can engage with said movable contact of said swivel assembly;

c) a contact spring which fits against the seat of said stationary contact member;

d) a contact button member having a well therein for holding said contact spring;

e) a second guide member to fit over said contact button member; and f) a pair of retainers for holding said first guide member to said second guide member.

4. A universal swivel device as recited in claim 3, wherein said base assembly further includes:

a) said outer housing having a pair of oppositely positioned side threaded apertures therein;

b) an interface adaptor having a pair of oppositely positioned side alignment grooves and a bottom internally threaded aperture, whereby said interface adaptor fits against said second guide member and said inner housing within said outer housing and the internally threaded aperture can engage with the threaded collar on the vehicular mount assembly;

c) a pair of socket head retaining screws, each threadable into one of the side threaded apertures in said outer housing to bear against one of the side alignment grooves in said interface adaptor thereby tightening the contact between said movable contact in said swivel assembly and said stationary contact member in said double acting contactor assembly;

d) a first spacer member having a first annular outer surface, a second wider annular outer surface and a clearance hole, said first spacer placed against said second guide member; and e) a second spacer member having an annular outer surface and an inner aperture, said second spacer member placed against said first spacer member, so that the bottom internally threaded aperture in said interface adaptor can engage with the threaded collar on the vehicular mount assembly.

5. A universal swivel device as recited in claim 4, wherein said lower housing in said swivel assembly, said inner housing in said base assembly and said second guide member in said double acting contactor assembly are all fabricated out of a non-conductive plastic material.

6. A universal swivel device as recited in claim 5, wherein said first gasket and said second gasket are fabricated out of a rubber material whereby when said first gasket and said second gasket are properly pressure seated, said movable contact of said swivel assembly will be weatherproofed.

* * * * *